United States Patent [19]

Yoshioka

[11] Patent Number: 4,638,815

[45] Date of Patent: Jan. 27, 1987

[54] WATER PIPE

[76] Inventor: Takeo Yoshioka, 8-16, Saihigashimachi 1-chome, Okayama, Japan

[21] Appl. No.: 809,414

[22] Filed: Dec. 16, 1985

[30] Foreign Application Priority Data

Jun. 26, 1985 [JP] Japan ..... 60-98444

[51] Int. Cl.[4] ..... A24F 1/30

[52] U.S. Cl. ..... 131/173; 131/198.1; 131/215.3

[58] Field of Search ..... 131/173, 198.1, 198.2, 131/202, 215.1, 215.2, 215.3, 198.2, 201

[56] References Cited

U.S. PATENT DOCUMENTS

| | | | |
|---|---|---|---|
| 1,249,984 | 12/1917 | Meissner | 131/173 |
| 1,543,043 | 6/1925 | Allen | 131/173 |
| 1,710,440 | 4/1929 | Torrese | 131/215.3 |
| 2,275,351 | 3/1942 | Doty | 131/215.3 |
| 2,825,342 | 3/1958 | Wang | 131/173 |
| 3,057,362 | 10/1962 | Flint | 131/173 |
| 4,134,310 | 1/1979 | Kahler | 131/173 |
| 4,201,230 | 5/1980 | Howell, Jr. | 131/173 |

FOREIGN PATENT DOCUMENTS

| | | | |
|---|---|---|---|
| 56669 | 5/1891 | Fed. Rep. of Germany | 131/215.3 |
| 60967 | 3/1892 | Fed. Rep. of Germany | 131/215.3 |
| 705 | of 1892 | United Kingdom | 131/215.3 |

*Primary Examiner*—V. Millin
*Assistant Examiner*—H. Macey
*Attorney, Agent, or Firm*—Wenderoth, Lind & Ponack

[57] ABSTRACT

An improved water pipe for a cigarette is proposed which has a bowl, a stem and a smoke tube extending through the bowl so as to reach into water contained in the bottom of the bowl. A ball retained at bottom of the smoke tube prevents water from entering the hole and cigarette and serves to bring nicotine up and out of the smoke tube.

1 Claim, 4 Drawing Figures

WATER PIPE

BACKGROUND OF THE INVENTION

The present invention relates to a water pipe for smoking a cigarette.

It has long been warned that smoking is detrimental to health. Various instruments have been proposed to remove any harmful substances such as nicotine contained in the smoke of tobacco. The inventor proposed a water pipe in Japanese patent application No. 47-66797 (publication No. 49-49597). FIG. 4 shows the prior art water pipe which comprises a bowl 1 closed at its top and bottom and a stem 2 extending horizontally. The bowl 1 is formed with a hole 6 tapered at the inner end portion to receive a cigarette. The hole 6 is formed in its inner wall with a plurality of axial grooves 5 tapering off. A first tube 10 for passage of smoke is attached to the end of the hole 6 so as to extend downwardly through a hole 11 in a funnel-shaped wall 9 formed on the tubular member 3 into a water reservoir 8 formed in the center of the cap 4. A second tube 13 is fixed in the inner end of the bowl 1 so as to extend downwardly into a room 14 above the funnel-shaped wall 9. The tube 13 communicates the room 14 with a smoke passage 7 extending through the stem 2. The tube 13 has an oblique end disposed adjacent to the upper surface of the funnel-shaped wall 9.

The conventional pipe is capable of removing harmful substances contained in the smoke by means of water contained in the pipe. However, when the pipe is laid down or turned upside down, water is liable to flow through the first tube 10 into the hole 6 for a cigarette. Since the water contains nicotine, it makes unsanitary the water pipe and gives discomfort to the smoker. Also, nicotine is liable to collect in the first tube 10, preventing smooth passage of smoke.

SUMMARY OF THE INVENTION

An object of the present invention is to provide an improved water pipe which obviates the abovesaid shortcomings.

In accordance with the present invention, there is provided a water pipe comprising: a bowl having a chamber and formed with a hole communicating with the chamber to receive a cigarette; a stem mounted on the bowl so as to extend laterally therefrom and formed with a smoke passage extending therethrough communicating with the chamber; a tubular member mounted on the bowl at bottom thereof and having a funnel-shaped wall formed with a hole in the center thereof; a cap removably mounted on the tubular member at bottom thereof and having a funnel-shaped surface formed with a water reservoir in the center thereof to contain water; a smoke tube extending vertically through the hole in the funnel-shaped wall into the water reservoir so as to communicate the hole for a cigarette with the water reservoir, the smoke tube having a small hole at a point slightly above its bottom; and a ball mounted in the smoke tube so as to be movable up and down therein, the smoke tube being adapted to hold the ball therein.

Other objects and features of the present invention will become apparent from the following description taken with reference to the accompanying drawings; in which:

DETAILED DESCRIPTION OF THE PREFERRED EMBODIMENT

Figure 1:
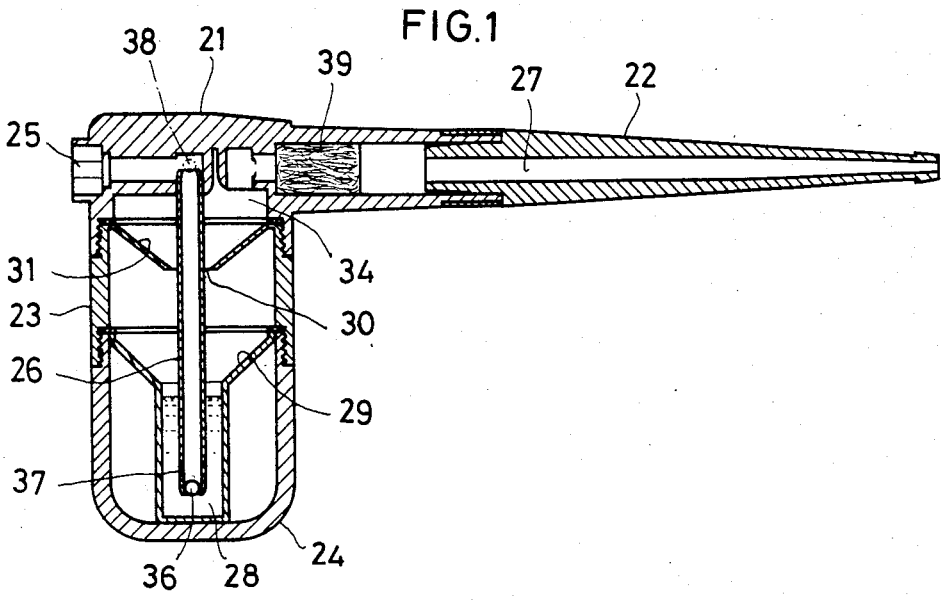
FIG. 1 is a vertical sectional view of a water pipe embodying the present invention.
Figure 2:
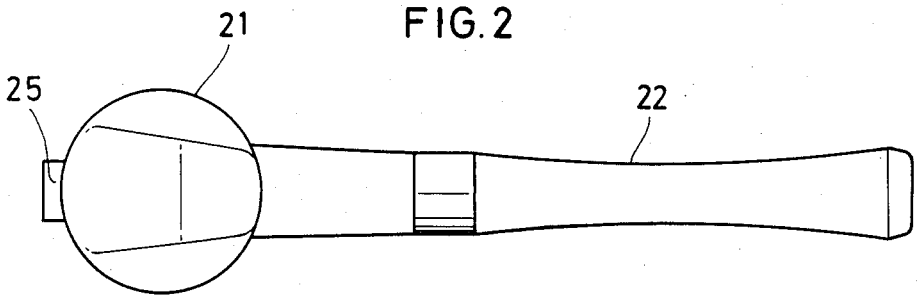
FIG. 2 is a top view thereof.
Figure 4:
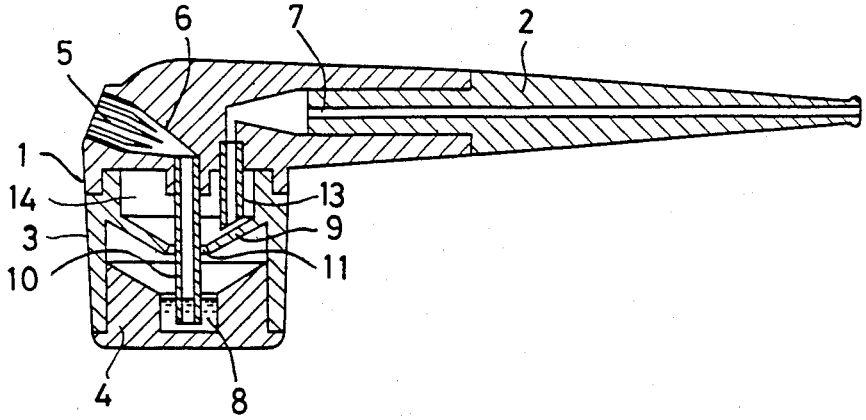
FIG.4 PRIOR ART
FIG. 4 is a view similar to FIG. 1 of a prior art water pipe.

Referring to FIG. 1, a water pipe of the present invention comprises a bowl 21 having a tubular member 23, a stem 22 extending laterally from the bowl 21, and a cap 24 closing the other end of the tubular member 23. The stem 22 is formed with a smoke passage 27 extending therethrough and opening into a chamber 34 in the bowl 21.

The bowl 21 is formed with a hole 25 to receive a cigarette. The cap 24 is formed in its inside with a funnel-shaped surface 29 and a water reservoir 28 for containing water.

Another funnel-shaped surface 31 is formed at top of the tubular member 23. A smoke tube 26 extends vertically through a hole 30 in the funnel-shaped surface 31 with a slight gap into the water reservoir 28 to communicate the hole 25 for a cigarrete with the water reservoir.

Figure 3:
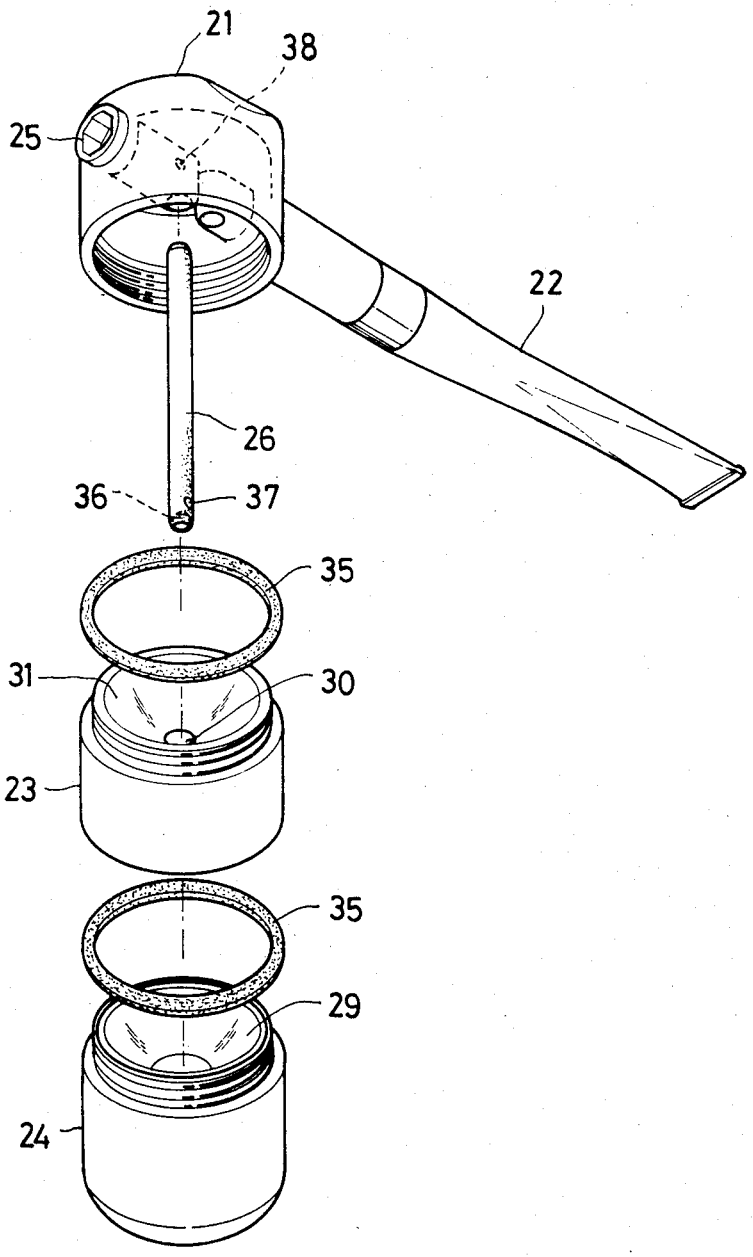
FIG. 3 is an exploded view thereof.

In the preferred embodiments, the pipe is formed by assembling the components 21, 22, 23 and 24 with packings 35 (FIG. 3) between the adjacent components. These members should preferably be made of a corrosion-resistant material such as synthetic resin.

Preferably, the funnel-shaped surface 29 should be away from the funnel-shaped surface 31 as far as possible. Since the surface 29 is funnel-shaped, water will return smoothly into the reservoir 28 after having flowed out of it when the pipe is laid down or tuned upside down.

The water reservoir 28 should preferably be as deep as possible and the smoke tube 26 should preferably extend into the water reservoir as deep as possible.

A small ball 36 is held in the smoke tube 26 so as to be movable up and down. The smoke tube 26 is open at its top and bottom, but its both ends are narrowed to prevent the ball 36 from getting out of the tube 26. The smoke tube 26 is formed with a small hole 37 slightly above its bottom end to allow passage of smoke.

The ball 36 serves to push up nicotine collected in the smoke tube 26 as it rolls up when the water pipe is turned upside down. The nicotine pushed up can flow through a hole 38 into the chamber 34. Also, the ball 36 serves to prevent water from the water reservoir from entering the hole 25 for a cigarette, because it comes up to the upper end of the smoke tube and stops up its upper opening when the water pipe is turned upside down.

The gap 30 between the funnel-shaped surface 31 and the smoke tube 26 is of such a size as to allow passage of smoke but not to allow water to leak therethrough. Since the edge of the hole 30 is sharp, water cuts well.

In use, when one puffs at the water pipe of the present invention with a cigarette in the hole 25, the inside of the water pipe will be under negative pressure so that the smoke from the cigarette will be sucked through the smoke tube 26, through the water in the reservoir 28, up through the gap 30, through the smoke passage 27, and into the mouth of the smoker. When the smoke passes through the water, harmful substances in the smoke will be removed.

During smoking, the nagative pressure in the pipe will vaporize part of the water in the reservoir 28. The vapor will promote the purification of the smoke. The vapor will adhere to the wall 31, turning into water drops, which fall again into the reservoir 28. Since there is a wide space between the wall 31 and the reservoir 28, the purifying action by water vapor is satisfactory.

When the water pipe of the present invention is laid down, the water will flow out of the reservoir 28 into the space below the wall 31. Since the space is ample enough to contain the water and the wall is funnel-shaped, water will hardly leak through the gap 30.

The smoke passage 27 should be formed with an enlarged portion 39 to contain a dry filter therein to remove moisture from smoke.

What I claim:

1. A water pipe comprising:

a bowl having a chamber and formed with a hole communicating with said chamber to receive a cigarette;

a stem mounted on said bowl so as to extend laterally therefrom and formed with a smoke passage extending therethrough communicating with said chamber;

a tubular member mounted on said bowl at bottom thereof and having a funnel-shaped wall formed with a hole in the center thereof;

a cap removably mounted on said tubular member at bottom thereof and having a funnel-shaped surface formed with a water reservoir in the center thereof to contain water;

a smoke tube extending vertically through the hole in said funnel-shaped wall into said water reservoir so as to communicate said hole for a cigarette with said water reservoir, said smoke tube having a small hole at a point slightly above its bottom; and a ball mounted in said smoke tube so as to be movable up and down therein, said smoke tube being adapted to hold said ball therein.

* * * * *